United States Patent [19]

Goytisolo Taltavull

[11] 4,004,145

[45] Jan. 18, 1977

[54] NIL-LUMINANCE LIGHTING PANEL

[76] Inventor: Ignacio Goytisolo Taltavull, Calle Madrazo, 83, Barcelona, Spain

[22] Filed: Feb. 24, 1975

[21] Appl. No.: 552,148

[52] U.S. Cl. ..... 240/106 R; 240/106.1

[51] Int. Cl.[2] ..... F21V 5/00

[58] Field of Search ..... 240/106 R, 106.1

[56] References Cited

UNITED STATES PATENTS

| | | | |
|---|---|---|---|
| 3,265,804 | 8/1966 | Berger et al. | 240/106 R |
| 3,288,990 | 11/1966 | Stahlhut | 240/106 R |
| 3,721,818 | 3/1973 | Stahlhut | 240/106 R |
| 3,735,124 | 5/1973 | Stahlhut | 240/106 R |

FOREIGN PATENTS OR APPLICATIONS

| | | | |
|---|---|---|---|
| 1,563,590 | 3/1969 | France | 240/106 R |

*Primary Examiner*—Russell E. Adams, Jr.
*Attorney, Agent, or Firm*—Wenderoth, Lind & Ponack

[57] ABSTRACT

A transparent prismatic low luminance lighting panel having on the outer or light-emissive surface thereof a plurality of refracting prismatic elements in the form of partially spherical domes overlapping one another and arranged in orthogonal rows and columns parallel to the length and width of the panel. The upper or light-incident surface of the panel has integral therewith a plurality of raised square-shape portions at positions opposite the square bases of the prismatic elements, or a plurality of longitudinal raised portions at positions opposite to the columns of the square bases. The upper surfaces of the raised portions are covered by a coating of an opaque material which stops and reflects any undesirable luminous rays falling thereon.

6 Claims, 8 Drawing Figures

NIL-LUMINANCE LIGHTING PANEL

CROSS REFERENCE TO RELATED APPLICATIONS

The subject matter of this application is related to the subject matter of my U.S. Pat. No. 3,716,709, issued on Feb. 13, 1973, and my U.S. Pat. No. 3,794,829, issued on Feb. 26, 1974.

BACKGROUND OF THE INVENTION

The invention refers to lighting panels for use in lighting units having fluorescent tubes as a lighting source, and more particularly refers to low luminance lighting panels of the type described in my above mentioned patents and which include an outer or light-emissive surface having a plurality of refracting elements in the form of cones or pyramids, the lateral surfaces of which are constructed such that luminous rays emerging from the cones or pyramids form angles of less than 60° with the axis of symmetry of the cones or pyramids so as to obtain a lighting panel of theoretically nil luminance.

In my U.S. Pat. No. 3,716,709 a panel includes cones the cross section of which through an axial plane is defined by two lines symmetric with respect to the axis of symmetry of domes, each one of which constitutes a first arc the center of which is situated on the opposite side of the axis of symmetry and above the plane of the base of the dome, a straight line segment tangential to such first arc, and a second arc tangential to such straight line segment, the center of which is situated at the other side of the axis of symmetry of the dome and in the plane of the base of the dome.

The special structure of such refracting domes, in theory, cause all the rays which emerge from the domes to form angles of not more than 60° with respect to the axis of symmetry of the domes. The remaining rays undergo total internal reflection and are reflected towards the interior face of the panel, thus being eliminated and giving a panel of theoretically nil luminance. However, in practice, some luminous rays with points of incidence at certain points on the interior or upper surface of the panel may emerge from the exterior face of the panel forming angles greater than 60° with respect to the axis of symmetry of the domes. These rays which form an angle of between 60° and 90° with the axis of symmetry of the domes are particularly bright and therefore are of primary concern with respect to the luminance of the panel where the rays strike the interior face of the panel in a direction which is normal or substantially normal to the surface of the panel, since such rays undergo little energy loss in their journey through the panel.

In my U.S. Pat. No. 3,794,829 a low luminance panel is described having on its exterior surface a plurality of prismatic refracting elements in the form of domes having a curved lateral surface and rounded apex in which the luminance caused by rays striking the panel at points on the interior or upper face in a normal or substantially normal direction to the interior surface of the panel is eliminated.

The domes of the panel of such patent have circular bases and a peripheral surface defined by a line composed of first and second arcs the center of which are situated on opposite sides of the axis of symmetry of the dome and above the plane of the base of the dome, first and second straight line segments tangential respectively to the first and second arcs, and a third arc tangential to the straight line segments and having its center situated at the intersection of the axis of symmetry of the dome with the plane of the base of the dome.

The domes of the panel of the patent are positioned with the bases of each two adjacent domes superimposed on each other in such a way that the lateral surfaces of the domes intersect, thus reducing or eliminating flat portions of the panel between domes, and therefore reducing the luminance of the panel, the domes being positioned either in staggered relation, the intersected bases of the cones thus having hexagonal form, or arranged in orthogonal rows and columns, the intersected bases of the domes thus being in square form.

It has however been found that some of those luminous rays which have their points of incidence on the interior face of the panel at positions corresponding with the lines of intersection of the bases of the domes, or which have points of incidence close to these positions, are refracted to emerge from the external surface of the domes at angles of 70° or more to the axis of symmetry of the domes, thus giving rise to a certain degree of luminance, while the other rays which have points of incidence at such mentioned positions on the interior surface of the panel undergo a series of total internal reflections. This leads to loss or to passing through the interior face of the panel, returning to the troffer of the apparatus with a large loss of luminous power, thus resulting in a lowering of the efficiency of the apparatus.

SUMMARY OF THE INVENTION

In consequence, the object of the invention is to obtain an improved luminous panel of the general type described in my U.S. Pat. Nos. 3,716,709 and 3,794,829.

Another object of the invention is to reduce the luminance and improve the efficiency in low luminance light panels.

Another object of the invention is to obtain a low luminance light panel which has on its outer surface a plurality of refracting domes the lateral surfaces of which are cut two by two, and in which all the luminous rays having points or incidence on the interior surface of the panel, at positions which are situated on or are near to the planes of intersection between the domes, are totally reflected towards the interior of the casing or housing of the lighting apparatus.

With the above in mind the invention includes a transparent light panel, having on its lower or light-sensitive surface a plurality of prismatic refracting elements in the form of partially spherical domes, arranged in orthogonal rows and columns, the lateral surfaces of the domes intersecting in such a way that their bases are square in form. On the upper surface of the panel there are a series of square recesses at positions which coincide with the square bases of the domes and which are separated by two orthogonal series of raised bands or which form a grid. The bands are covered with a coating of opaque reflecting material which reflects towards the interior of the lighting apparatus casing those undesirable luminous rays which have points of incidence on the bands.

DESCRIPTION OF PREFERRED EMBODIMENTS

The primary purpose of this invention is to improve the lighting panel described in my U.S. Pat. No. 3,794,829, such panel having on its outer or light-emissive surface a plurality of refracting domes arranged in orthogonal rows and columns and partially overlapping one another, the bases of such domes being of square form.

Figure 1:
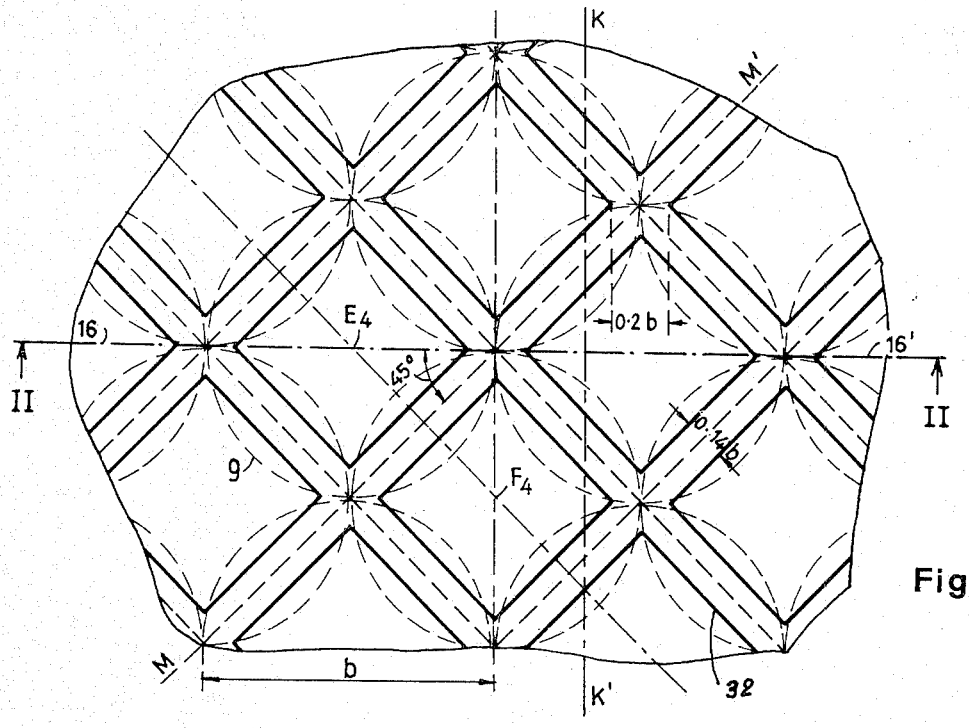
FIG. 1 is a top view of a portion of a panel of the invention.
Figure 2:
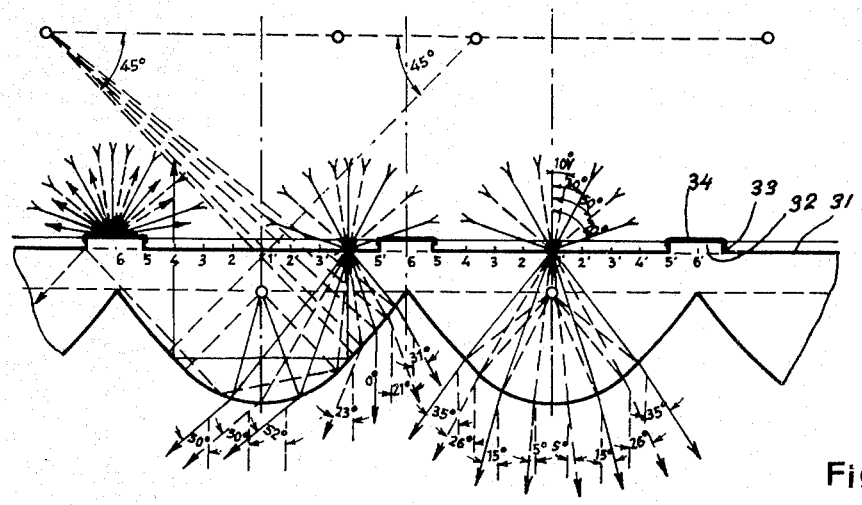
FIG. 2 is a schematic cross-sectional view through the line II—II of FIG. 1, showing the path of the rays through the panel.
Figure 3:
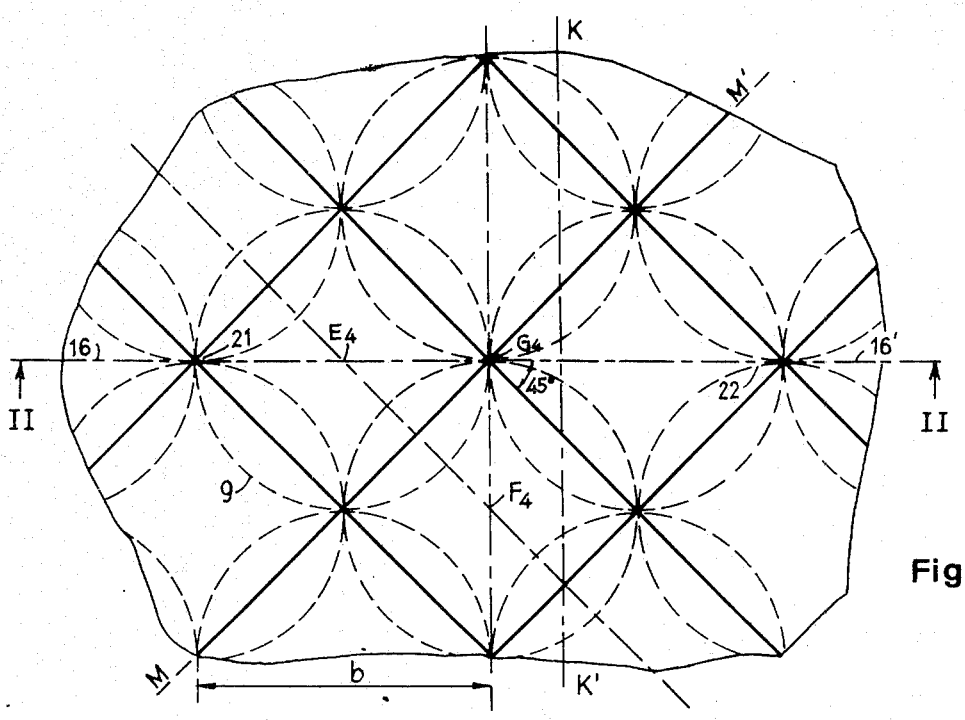
FIGS. 3 and 4 are reproductions of FIGS. 7 and 8 of U.S. Pat. No. 3,794,829, provided here for comparison purposes.
Figure 4:
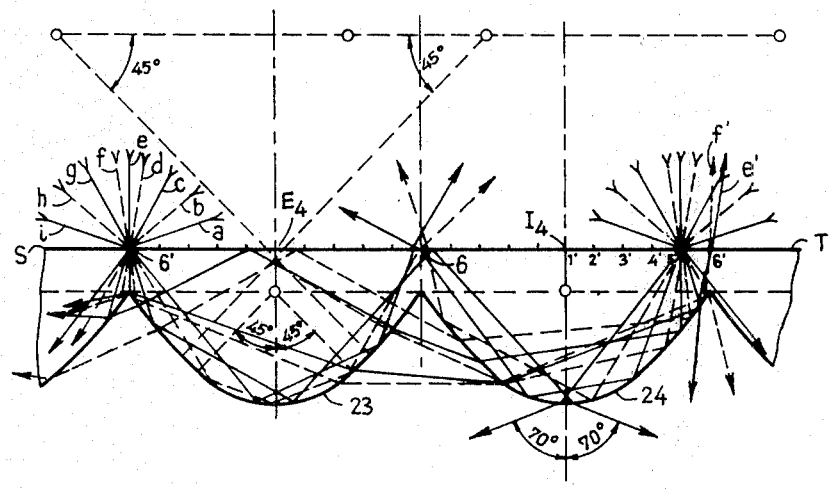

The panel of the invention represented in FIGS. 1 and 2 also has a plurality of refracting domes on its exterior or lower surface, such domes having a profile in axial transversal section equal to that of the domes of the panel represented in FIGS. 3 and 4 and described in the mentioned U.S. Pat. No. 3,794,829, the domes of which are arranged in orthogonal rows and columns, and the bases of each dome being in a square form.

As shown in FIG. 4, in the panel of the aforementioned patent the points 6′ on the interior or upper panel surface TS coinciding with the lines of intersection MM′ of the bases of the domes, and points such as 5′ near to points 6′, when having luminous rays *a*, *b*, *c*, ..... *i* incident thereon, such rays in great part undergo various total internal reflections, being lost in the interior of the domes or re-emerging through the interior through face of the panel after having undergone large loss of luminous power. Some of these rays, such as *a* and *g*, are refracted and emerge through the exterior or lower face of the panel and form with the axis of symmetry of the domes angles of between 70° and 85°. This means that in such a panel there is still produced a certain degree of luminance and a lowering of efficiency, due to the rays which have points of incidence between points 5′ and 6′.

The present invention avoids those rays with an inclination above 70°. For this, the upper surface of the panel has therein a plurality of square recesses at positions coinciding exactly with the square bases of the domes.

The arrangement of FIG. 1 and FIG. 2 thus presents the aspect of a grid formed by raised bands or strips defining therebetween flat surfaces 31. The strips have an upper surface 32 and lateral walls or edges 33 normal to the flat surface 32. The strips or bands are of a very low height but are sufficiently high to enable them to be easily painted with an opaque coating of shiny white or specular material in such a way that those rays which are incident at points such as point 6 of FIG. 2 are reflected onto the interior reflecting surface, thus producing a uniform luminous aspect.

Thus, the rays incident on points 1′, 2, 3, 4, 2′, 3′, 4′, of FIG. 2 are refracted as represented for the points 1′ and 4′, while those rays which are incident on points 5, 5′, 6, 6′ are intercepted at their origin. As shown by comparison with FIG. 4, it can be seen that the rays which have their point of incidence at such points 5, 5′, 6, 6′ in the former panel are not refracted towards the exterior and lower part of the panel, except for some rays which do so with an inclination of some 70° to the vertical, the rest of the rays being lost in successive total internal reflections or by passing towards the upper part of the panel that is the troffer which holds fluorescent tubes.

It should be noted that this result is achieved without double texturing in the upper part of the panel, that is to say, without a succession of semi-spherical hollows which by their nature are dust catchers and which in practice, contrary to the panel of invention, permit the fluorescent tubes to be seen from outside since such panels distribute light but do not diffuse light, thereby necessitating the fitting of diffusing sheets over the panel which as well as being more complicated decrease the efficiency of the apparatus.

Figure 6:
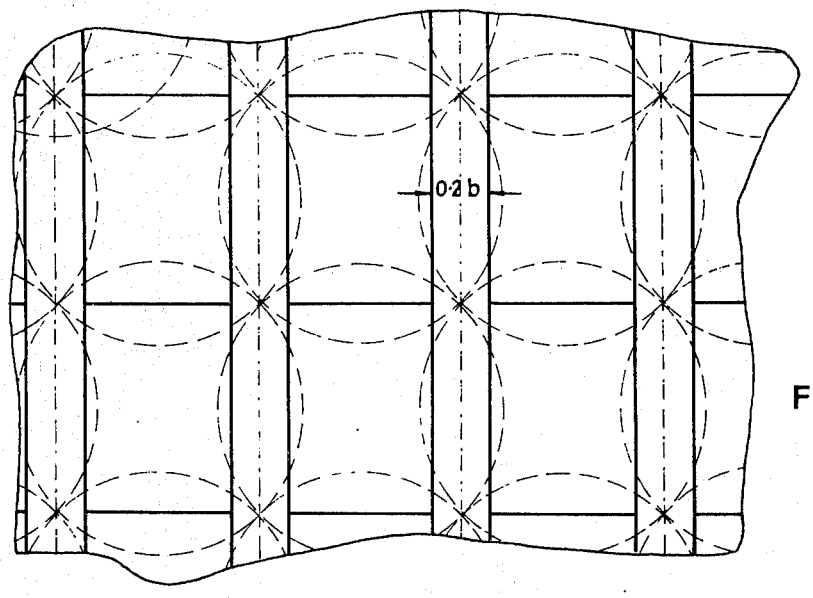
FIG. 6 is a top view of a portion of another embodiment of the panel.

The bands or strips have a total transversal width between $0.14b$ and $0.2b$, $b$ being the length of the diagonal of the squared bases of the domes. In FIG. 1 the width appears as $2 \times \cos 45° \times 0.1b = 0.14b$ which corresponds to a width of $0.2b$ in the section according to II—II, but this width according to FIG. 4 corresponds to point 5′ where rays are emitted at 70° and thus in practice the width may be somewhat greater as shown in FIG. 6, that is to say a width of $0.2b$ for the transversal section of the strips.

As a variant to the above embodiments, the apparatus may be formed to produce a polar curve of distribution somewhat wider but still of low luminance. For this the sections of the domes may have the form shown in FIG. 5 wherein the center of the spherical part is above the upper plane of the apparatus. Comparing FIG. 2 with FIG. 5 regarding the rays with points of incidence at point 1′ it is seen that those rays having an angle of incidence of 70° leave at an angle of 35° in FIG. 2 and 42° in FIG. 5.

Figure 5:
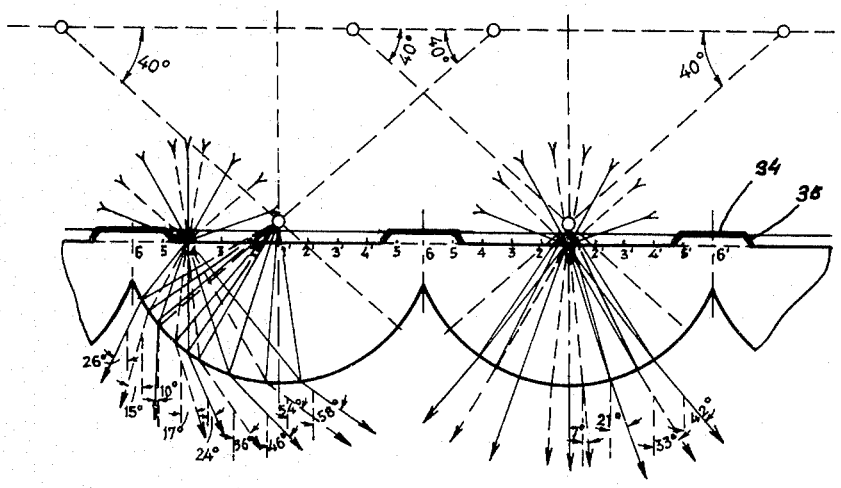
FIG. 5 is a schematic cross-sectional view similar to that of FIG. 2 of a panel having a modified type of domes.

With regard to point 4′, the rays with an angle of incidence of 70° leave at 50° and 31° in FIG. 2 and at 58° and 26° in FIG. 5. It must be kept in mind that the strip or band which has a width of more than $0.2b$ for a section according to II—II of FIG. 1, that is to say, that it covers somewhat more than the distance between points 5 and 5′ in FIG. 2, would have an even greater value. That is, such value would be near the distance between 4 and 4′ in the case of FIG. 5, since there are rays which in this case have points of incidence between 4 and 5 or 4′ and 5′ which come out with angles near the value of 70°.

In FIG. 5 such greater width of the bands is obtained without varying the width of the upper surface of the bands, but by making the lateral edges of the bands bevelled in order to not cut off the inclined rays adjacent to the bands. Of course, such bevelled edges of the bands also should be covered with the coating 34 common to all the bands.

In FIG. 6 the strips or bands are represented as extending in only one direction parallel to one of the sides of the square bases of the domes. This is to facilitate the manufacture of the panel by extrusion, since the strips or bands will follow the direction of the material extruded. Obviously the correction of rays above 60° would be made in a direction cross to the axis of the strips or bands, that is there would be a preferable direction of correction.

It is necessary that the square bases of the domed elements be placed parallel and perpendicular to the length and width of the panel. That is, orthogonal columns and rows of the bands must be parallel and perpendicular to the fluorescent tubes, and not on a 45° to the axis.

Figure 7:
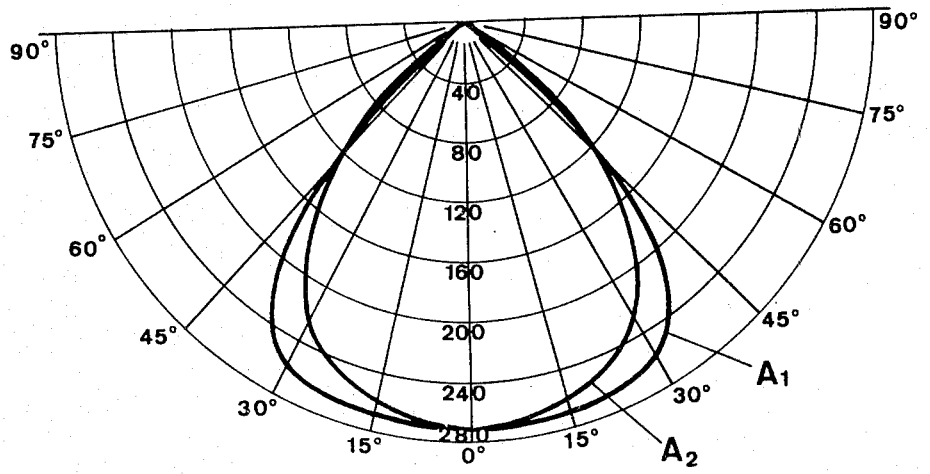
FIG. 7 is the candlepower distribution curve based on 1,000 lumens corresponding to the panel of FIGS. 1 and 2.

FIG. 7 shows the candlepower distribution curve based on 1000 lumens corresponding to trials with a fluorescent lighting apparatus fitted with a clear acrylic panel like that of FIGS. 1 and 2, that is, with orthogonal bands forming a grid and in which the performance is improved since there is no loss of rays and there is little total internal reflection in the panel. Curve $A_1$ corresponds to a plane normal to the lamps, and curve $A_2$ corresponds to a plane parallel to the lamps.

Figure 8:
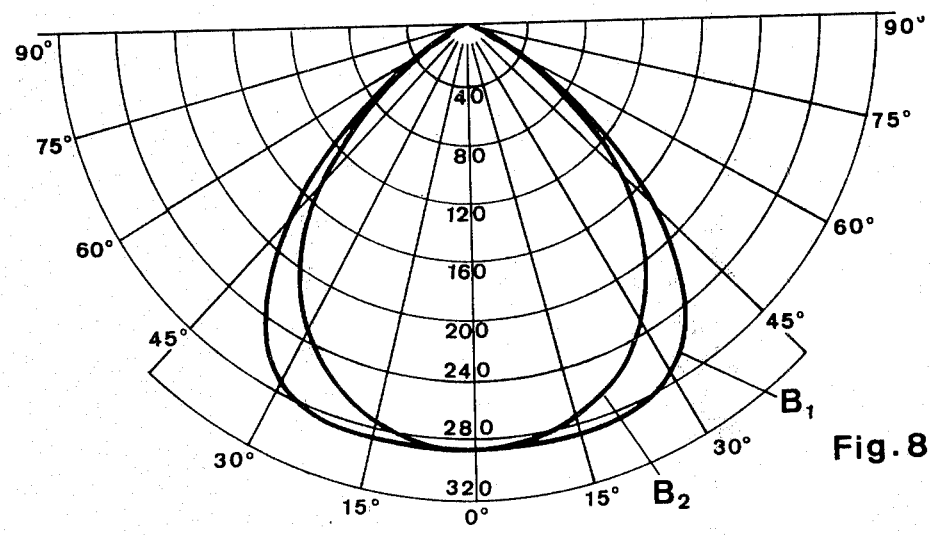
FIG. 8 is the candlepower distribution curve based on 1,000 lumens corresponding to a panel having its outer surface as shown in FIG. 2 and its interior surface as shown in FIG. 6.

FIG. 8 shows the candlepower distribution curve based on 1000 lumens corresponding to trials with a fluorescent lighting apparatus fitted with a clear acrylic panel like that of FIGS. 6 and 2, that is, with bands or strips parallel to the length of the panel. Curve $B_1$ corresponds to a plane normal to the lamps, and curve $B_2$ corresponds to a plane parallel to the lamps.

The four cases $A_1$, $A_2$, $B_1$, $B_2$, fulfill the scissors curve criteria of the United States standard practice relative to the low luminance.

What I claim is:

1. A low luminance lighting panel comprising:

a panel member having a light-incident surface and a light-emissive surface;

said light-emissive surface having thereon a plurality of refracting prismatic elements of partially spherical dome shape, each having a circular cross-section, an axis of symmetry, and lateral surfaces each defined by lines symmetric to said axis of symmetry, each of said lines being composed of a first circular arc having a center located above the plane of said light-incident surface of said panel member and beyond said axis of symmetry and a second arc tangential to said first arc and having a center located on said axis of symmetry and above the plane of the base of said dome shaped elements, said lateral surfaces of adjacent of said dome shaped elements intersecting so that the bases of said dome shaped elements are square shaped and arranged in orthogonal transverse rows and longitudinal columns respectively parallel to the width and the length of said panel member;

said panel member having in said light-incident surface alternate longitudinal recesses positioned to coincide with the longitudinal columns of square shaped bases of dome shaped elements, and longitudinal raised bands each having an upper surface and lateral edges, said bands positioned to coincide with the longitudinally extending intersection lines between lateral surfaces of said dome shaped elements, said recesses having planar base surfaces;

said upper surface and lateral edges of each of said bands having thereon a coating of an opaque reflecting material; and said panel member, said refracting elements and said bands being integrally formed as a single unitary member.

2. A low luminance lighting panel as claimed in claim 1, wherein said lateral edges of said bands are bevelled.

3. A low luminance lighting panel as claimed in claim 1, wherein said bands each have a width between 0.14 and 0.2 times the length of the diagonal of said square bases of said dome shaped elements.

4. A low luminance lighting panel comprising:

a panel member having a light-incident surface and a light-emissive surface;

said light-emissive surface having thereon a plurality of reflecting prismatic elements of partially spherical dome shape, each having a circular cross-section, an axis of symmetry, and lateral surfaces each defined by lines symmetric to said axis of symmetry, each of said lines being composed of first and second circular arcs, said first arc having a center located beyond said axis of symmetry and above the plane of said light-incident surface of the panel member, and said second arc having its center located on said axis of symmetry and above the plane of the base of said dome shaped elements, said lateral surfaces adjacent of said dome shaped elements intersecting so that the bases of said dome shaped elements are square shaped and arranged in orthogonal rows and columns respectively parallel to the length and the width of said panel member;

said panel member having in said light-incident surface a plurality of square recesses positioned to coincide with said square bases of said dome shaped elements, and two series of orthogonal raised bands with an upper surface and lateral edges, said bands being positioned to coincide with the orthogonal lines of intersection between said lateral surfaces of said dome shaped elements, said recesses having planar base surfaces;

said upper surface and lateral edges of said bands having thereon a coating of an opaque reflecting material; and said panel member, said refracting elements and said bands being formed as a single unitary member.

5. A low luminance lighting panel as claimed in claim 4, wherein said lateral edges of said bands are bevelled.

6. A low luminance lighting panel as claimed in claim 4, wherein said bands each have a width between 0.14 and 0.2 times the length of the diagonal of said square bases of said dome shaped elements.

* * * * *